United States Patent [19]

Mitsumori

[11] Patent Number: 4,777,402

[45] Date of Patent: Oct. 11, 1988

[54] THIN FILM EL DISPLAY DEVICE HAVING MULTIPLE EL LAYERS

[75] Inventor: Kenichi Mitsumori, Furukawa, Japan

[73] Assignee: Alps Electric Co., Ltd., Japan

[21] Appl. No.: 872,213

[22] Filed: Jun. 6, 1986

[30] Foreign Application Priority Data

Jun. 7, 1985 [JP] Japan ..... 60-123881

[51] Int. Cl.[4] ..... H01J 1/62

[52] U.S. Cl. ..... 313/509; 313/505; 313/506; 313/169.3; 315/169.3

[58] Field of Search ..... 315/169.3; 313/503, 313/505, 506, 509; 427/66; 428/917; 340/760, 761, 781, 825.81

[56] References Cited

U.S. PATENT DOCUMENTS 4,099,091 7/1978 Yamazoe et al. ..... 313/509
4,418,118 11/1983 Lindors ..... 313/506
4,446,399 5/1984 Endo et al. ..... 313/509

*Primary Examiner*—David K. Moore

*Assistant Examiner*—T. Salindong

*Attorney, Agent, or Firm*—Guy W. Shoup; Paul J. Winters

[57] ABSTRACT

A thin film EL display device comprising a transparent conductive film formed on a transparent substrate, a first EL emission film formed on the transparent conductive film directly or by way of an insulation film, at least one set of voltage applying electrodes not connected electrically with each other and formed on the EL emission film directly or by way of an insulation film, a second EL emission film formed on the voltage applying electrode directly or by way of an insulation film and a conductive film formed on the second EL emission film directly or by way of an insulation film. Multi-color display is possible by the combination of emission color of the first EL emission film and/or the emission color of the second emission film. Easy lead out for the electrode is possible and pattern shape and width can optionally be set not restricted to the material for the transparent conductive film.

4 Claims, 2 Drawing Sheets

THIN FILM EL DISPLAY DEVICE HAVING MULTIPLE EL LAYERS

BACKGROUND OF THE INVENTION

1. Field of the Invention

This invention concerns a thin film electroluminescent display device having two layers of electroluminescent films, and capable of multicolor display by causing these electroluminescent films to emit light respectively.

2. Description of the Prior Art

Thin film electroluminescent display devices (hereinafter simply referred to as EL display device) have been applied to the display of various types of devices in recent years. A conventional thin film EL display device in the prior art usually comprises a 6-layered structure, in which a transparent conductive film, an insulation film, an EL emission film, an insulation film and an opposing electrode film are successively laminated on a transparent substrate. The thin film EL display device is adapted such that when an alternating electric field from several tens Hz to several KHz is applied between the transparent conductive film and the opposing electrode film, ions of activated species in the EL emission film are excited to emit light. However, in the above-mentioned thin film EL display device, it has only been possible to obtain a single display color determined by the material or the like for the EL emission film.

In view of the above, a thin film EL display device for enabling multicolor display by disposing two layers of the EL emission films has been considered. The conventional EL display device having two layers of EL emission films comprises, as shown in FIG. 3, a structure in which a transparent conductive film 2, an insulation film 3, a first EL emission film 4, an insulation film 5, an intermediate electrode film 6, an insulation film 7, a second EL emission film 8, an insulation film 9 and an opposing electrode film 10 are successively laminated on a transparent glass substrate 1. When an alternating electric field is applied between the transparent conductive film 2 and the intermediate electrode film 6, the first EL emission film emits light and, when an alternating electric field is applied between the intermediate electrode film 6 and the opposing electrode film 10, the second EL emission film emits light. The multicolor display can be attained by varying the material between the first EL emission film 4 and the second EL emission film 8.

However, in the above-mentioned conventional thin film EL display device having two layers of EL emission films, it is necessary in view of the structure thereof to lead out the electrodes from three electrode films 2, 6 and 10 respectively to render the electrode leading out work complicated.

Further, an improvement has been demanded for the resolution power upon display accompanying with the increasing use as the display for various kinds of devices. However, since it is necessary that the electrode film on the side for taking out EL emission (usually the electrode film on the side of the transparent glass substrate) is a transparent conductive film and since the transparent conductive film available at the present technical level has a specific resistivity of about $2\times20^{-4}$ Ωcm, it is considered to narrow the pattern width for improving the resolving performance upon display. However, narrowing for the pattern width leads to the increase in the conductive resistance upon leading out the electrodes. If the conduction resistance of the pattern at the transparent conductive film is increased, uneven brightness is resulted in the EL emission to degrade the display quality. Accordingly, there has been a limit for the pattern width of the transparent conductive film.

OBJECT OF THE INVENTION

It is an object of this invention to overcome the foregoing problems in the prior art and provide a thin film EL display device having two layers of EL emission films capable of facilitating electrode leading and with no effects from the specific resistivity of the transparent conductive film.

SUMMARY OF THE INVENTION

The foregoing object of this invention can be attained with a thin film EL display device comprising a transparent conductive film formed on a transparent substrate, a first EL emission film formed on the transparent conductive film directly or by way of an insulation film, at least one set of voltage applying electrodes not connected electrically with each other and formed on the EL emission film directly or by way of an insulation film, a second EL emission film formed on the voltage applying electrode directly or by way of an insulation film and a conductive film formed on the second EL emission film directly or by way of an insulation film.

In this invention, a voltage is not applied directly to the transparent conductive film formed on the transparent substrate and to the conductive film formed at the rearmost side but an alternating current is applied between at least one set of the voltage applying electrodes formed between the first EL emission film and the second EL emission film. Each of the transparent conductive films serve to form an equi-potential surface. Accordingly, the electric field caused by the alternating voltage is established between the voltage applying electrodes and the transparent conductive film on the transparent substrate disposed closer thereto and between the voltage applying electrodes and the conductive film formed at the rearmost side. In this way, the first EL emission layer emits light when an alternating electric field is applied between the voltage applying electrodes and the transparent conductive film formed on the transparent substrate, while the second EL emission film emits light when an alternating electric field is applied between the voltage applying electrodes and conductive film disposed at the rearmost side.

In this invention, the emission of the first EL emission film is effected at a portion where the transparent conductive film on the transparent substrate and the voltage applying electrodes are overlapped with each other. Further, the emission of the second emission film is effected at a portion where the voltage applying electrodes and the conductive film formed on the rearmost side are overlapped with each other. Then, at the portion where the transparent conductive film on the transparent substrate, the voltage applying electrodes and the conductive film formed at the rearmost side are entirely overlapped with each other, the emission from the first EL emission film and the emission from the second EL emission film are superimposed, in which the emission amount and the emission color are formed as the sum of them. In this way, since thre are formed a portion where only the first EL emission film emits light, a portion where only the first or the second EL emission film emits light and a portion where the first EL emission film and the second EL emission film emit light superimposingly, multicolor display is possible by varying the emission colors of the first EL emission film and the second EL emission film.

Further, in this invention, since the voltage is directly applied only to at least one set of voltage applying electrodes formed at the intermediate portion, the electrode can be led out easily. Further, since no electric current is supplied to the transparent conductive film on the transparent substrate and to the rearmost side conductive film, the pattern shape and width can optionally be set while requiring no consideration for the specific resistivity of the conductive film. While at least one set of the voltage applying electrodes are separately formed such that they are not connected electrically, the distance therebetween is preferably made greater by twice or more than the gap between the transparent conductive film on the transparent substrate and the voltage applying electrodes or the gap between the voltage applying electrodes and the conductive film formed on the rearmost side, which is greater. If the distance between at least one set of voltage applying electrodes with each other is narrower than the above, the light emission pattern is disturbed under the effect of the electric field exerted between the voltage applying electrodes.

Upon taking out the emissions of the first and second EL emission films together on the side of the transparent substrate, although it is necessary to render the transparent conductive film on the substrate and the voltage applying electrodes transparent, the rearmost side conductive film is not necessarily transparent. Further, it is possible in this invention to take out the emission of the first EL emission film on the side of the transparent substrate and take out the emission of the second EL emission film from the back. In this case, although it is necessarily to render the transparent conductive film on the transparent substrate and the rearmost conductive film transparent, the voltage applying electrodes are not necessarily be transparent.

BRIEF DESCRIPTION OF THE ACCOMPANYING DRAWINGS

These and other objects, features as well as advantages of this invention will be made clearer by reading the following descriptions for preferred embodiments thereof in conjunction with the accompanying drawings, wherein FIG. 1 is a fragmentary cross sectional view for one embodiment of a thin film EL display device according to this invention, FIG. 2 is a schematic plan view for the light emitting state of the thin film EL display device, and FIG. 3 is a fragmentary cross sectional view for a conventional thin film EL display device.

DESCRIPTION OF PREFERRED EMBODIMENT

Figure 1:
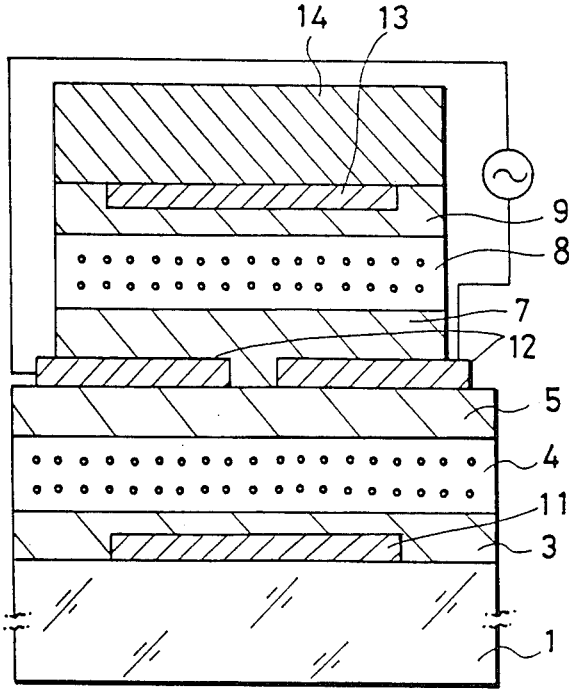
Figure 2:
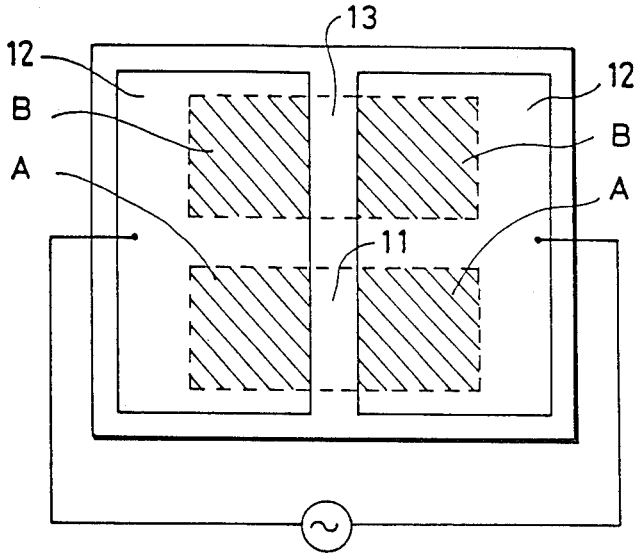
Figure 3:
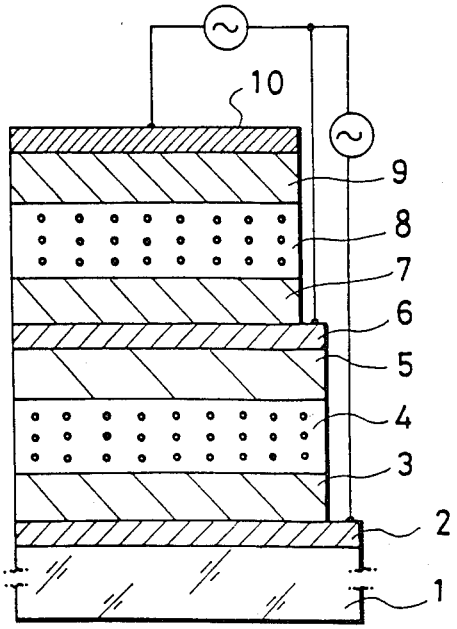
FIG. 3 PRIOR ART

FIG. 1 and FIG. 2 show one embodiment of the thin film EL display device according to this invention. As shown in FIG. 1, a transparent conductive film 11 of $In_2O_3$ - $SnO_2$ series is formed to a thickness of about 2000 Å on a commercially available transparent glass substrate (Corning #7059) 1 by way of sputtering and then etched into a configuration shown by the dotted line in FIG. 2. Next, an insulation film 3 made of tantalum pentoxide ($Ta_2O_5$) is formed to a thickness of about 1000 Å on the transparent conductive film 11 by way of reactive sputtering. Successively, a first EL emission film 4 made of manganese- doped zinc sulfide (ZnS:Mn, Mn=0.3 at %) is formed to a thickness of about 6000 Å by way of sputtering and then an insulation film 5 made of tantalum pentoxide is formed to a thickness of about 3000 Å further thereover by way of a reactive sputtering. Then, a conductive film made of ITO is formed to a thickness of about 2000 Å by way of sputtering and subsequently etched to form one set of voltage applying electrodes 12, 12 separated from each other by a widthwise gap in the widthwise direction of the display device. The voltage applying electrodes 12, 12 lie in one plane which is separated from the plane of the transparent conductive film 11 by a first depthwise gap in the depthwise direction of the display device. Then, an insulation film 7 made of tantalum pentoxide is formed to a thickness of about 3000 Å on the voltage supplying electrodes 12, 12 by way of reactive sputtering. Successively, an El emission film made of zinc sulfide doped with terbium (Tb) (ZnS:Tb) is formed by way of sputtering. Further, an insulation film 9 made of tantalum pentoxide is formed to a thickness of about 1000 Å by way of reactive sputtering and a conductive film 13 made of ITO is formed further thereover to a thickness of about 2000 Å by way of sputtering and then etched into a configuration shown by the dotted line in FIG. 2. The conductive film 13 lies in another plane separated from the voltage applying electrodes 12, 12 by a second depthwise gap in the depthwise direction of the display device. Preferrably, the widthwise gap between the voltage applying electrodes is made two times or more greater than the first depthwise gap between the electrodes and the front conductive film 11, or than the second depthwise gap between the electrodes and the rear conductive film 13, whichever is greater, in order to provide the desired light emission effect. Finally, a passivation film 14 made of silicon nitride oxide ($SiN_xO_y$) is formed to a thickness of about 1 μm by way of sputtering to obtain a thin film EL display device.

As shown in FIG. 2, when an alternating voltage is applied to the voltage applying electrodes 12, 12 in the thin film EL display device, orange yellow light is emitted as the emission color of the first emission film in the portion A where the voltage applying electrodes 12, 12 are overlapped with the transparent conductive film 11 and green color is emitted as the emission color of the second EL emission film 8 in FIG. 1 at the portion B where the voltage applying electrodes 12, 12 are overlapped with the conductive film 13.

In the foregoing embodiment, if the transparent conductive film 11, the voltage applying electrodes 12, 12 and the conductive film 13 are entirely overlapped with each other, it is possible to obtain in the overlapped area, a color synthesized from the emission color of the first EL emission film 4 and the emission color of the second EL emission 8 to thereby obtain 3-color display.

As has been explained above according to this invention, it is possible to obtain a emission color from the first EL emission film, an emission color from the second EL emission film and, optionally, an emission color synthesized therefrom to enable multi-color display. Further, since it is only necessary to apply a voltage to at least one set of voltage applying electrodes disposed at the intermediate portion, the electrodes can be led out easily. Furthermore, since it is no more necessary to supply electric current to the transparent conductive film on the transparent substrate and to the rearmost conductive film, the pattern shape and the width can optionally be set with no effects from the specific resistivity of these conductive films, whereby transparent conductive film material of relatively high resistance can be employed.

What is claimed is:

1. A multi-color thin film EL display device for selectively illuminating multiple EL layers comprising, in order, a front, transparent conductive film formed on a transparent susbstrate in parallel with a display plane of the display device;

a first EL emission film formed on the front transparent conductive film directly or by way of an insulation film, a pair of intermediate electrodes lying in one intermediate plane in parallel with the display plane of the display device, said intermediate electrodes being separated from said front transparent conductive film by a first depthwise gap, said intermediate electrodes being spaced apart by an intermediate widthwise gap so as to be not connected electrically with each other and being formed on said first EL emission film directly or by way of an insulation film, a second EL emission film formed on said pair of intermediate electrodes directly or by way of an insulation film, a rear conductive film formed on said second EL emission film directly or by way of an insulation film in parallel with the display plane of the display device which is separated from said plane of said intermediate electrodes by a second depthwise gap, and means for connecting an alternating voltage to said pair of intermediate electrodes so as to create a first electric field between said front transparent conductive film as an equipotential surface and said intermediate electrodes for causing said first EL emission film to emit a first color of light, and a second, different electric field between said intermediate electrodes and said rear conductive film as another equipotential surface for causing said second EL emission film to emit a second color of light.

2. The thin film EL display device as defined in claim 1, wherein the first EL emission film and the second EL emisison film are made of zinc sulfide incorporating with doping material different from each other.

3. The thin film EL display device as defined in claim 1, wherein the transparent conductive film is made of $In_2O_3 \cdot SnO_2$ (ITO) material.

4. The thin film EL display device as defined in claim 1, wherein the insulation film is made of tantalum penoxide ($Ta_2O_5$).

* * * * *